US005974687A

United States Patent [19]

Gante et al.

[11] Patent Number: 5,974,687

[45] Date of Patent: Nov. 2, 1999

[54] METHOD FOR DRYING LACQUERS AND OTHER COATINGS ON METAL OR NON-METAL INDIVIDUAL COMPONENTS OR ASSEMBLIES USING MICROWAVES

[75] Inventors: Thomas Gante, Ritterhude; Dieter Buetergerds, Ohne; Armin Fangmeier, Rahden, all of Germany

[73] Assignee: DaimlerChrysler Aerospace, Hamburg, Germany

[21] Appl. No.: 09/082,387

[22] Filed: May 20, 1998

[30] Foreign Application Priority Data

May 22, 1997 [DE] Germany ..... 197 21 461
Jul. 18, 1997 [DE] Germany ..... 197 30 879

[51] Int. Cl.[6] ..... F26B 3/34

[52] U.S. Cl. ..... 34/265; 427/512; 427/544

[58] Field of Search ..... 34/245, 259, 264, 34/265, 438, 439, 440; 219/686, 751, 752, 753; 427/488, 491, 512, 517, 544

[56] References Cited

U.S. PATENT DOCUMENTS

| | | | |
|---|---|---|---|
| 4,879,444 | 11/1989 | Bichot et al. | 34/265 X |
| 5,335,425 | 8/1994 | Tomizawa et al. | 34/265 |
| 5,467,694 | 11/1995 | Mochizuki et al. | 34/265 X |
| 5,607,730 | 3/1997 | Ranalli | 427/512 |
| 5,612,097 | 3/1997 | Foerch et al. | 427/512 X |
| 5,732,476 | 3/1998 | Pare | 34/265 |
| 5,789,039 | 8/1998 | Biller et al. | 427/512 |

FOREIGN PATENT DOCUMENTS

| | | |
|---|---|---|
| 2458323 | 1/1981 | France . |
| 4121203A1 | 1/1993 | Germany . |
| 4-260472 | 1/1993 | Japan . |

OTHER PUBLICATIONS

Publication "Deutsche Farben–Zeitschrift" (German Color Journal) 23rd year, No. 12, (1969), p. 585.

*Primary Examiner*—Henry Bennett
*Assistant Examiner*—Steve Gravini
*Attorney, Agent, or Firm*—W. F. Fasse; W. G. Fasse

[57] ABSTRACT

In a method for drying coating films on coated components, microwaves are generated by at least one magnetron (3A) in at least one microwave generator module (3) and introduced into a drying chamber (2A) through one or more waveguides (4). Air or another gas is blown from a blower (5) into the drying chamber (2A). An additive agent comprising a dipolar or polarizable molecular composition is mixed into the gas to form a gas mixture within the drying chamber (2A). The coated components (9) are placed into the drying chamber (2A) in a batch or continuous flow-through process. The microwave energy vibrationally excites and heats the additive agent in the gas mixture, which in turn heats the coating film (9') on the components (9). Alternatively, the additive agent may be mixed or applied directly in the coating film substance, so as to achieve direct heating of the coating film, or so as to evaporate from the coating film into the gas to form the gas mixture. The gas is preferably air, and the additive agent is preferably water vapor in a prescribed and controlled relative proportional content within the range from 20% to 90%, which is maintained within the drying chamber. The component may be a metal component or a non-metal component, and the coating may be a water-thinnable or solvent-containing one-, two-, or more component lacquer based on an epoxy, or a polyurethane, or an alkyde resin, or an acrylic resin. Uniform drying of the coating film is achieved even on components having a complex geometry.

35 Claims, 1 Drawing Sheet

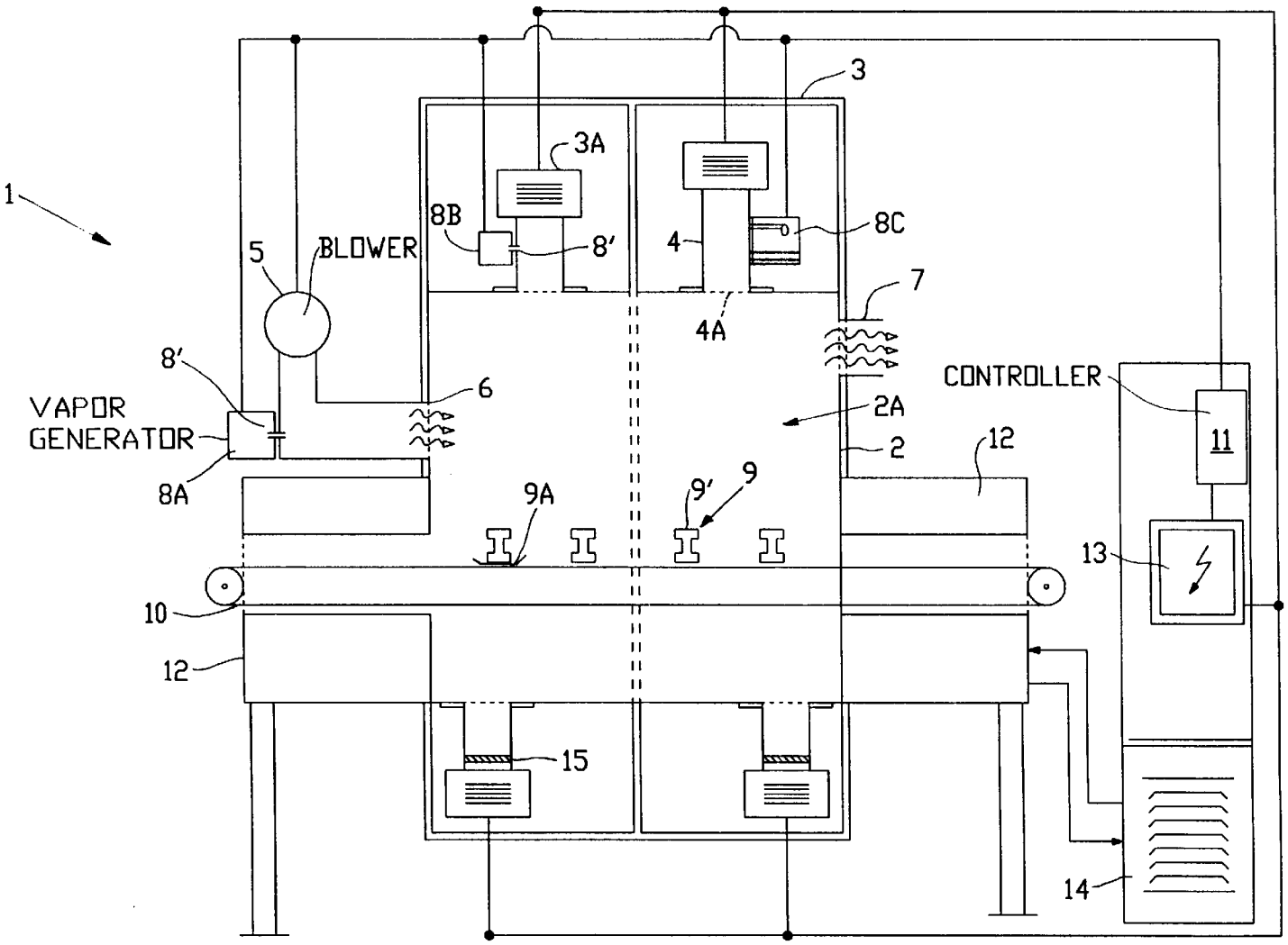
CONTROLLER
11
13
14
12
7
8C
2A
2
3
4A
4
9
9'
3A
8'
9A
15
8B
6
BLOWER
5
8'
VAPOR GENERATOR
8A
10
12
1

METHOD FOR DRYING LACQUERS AND OTHER COATINGS ON METAL OR NON-METAL INDIVIDUAL COMPONENTS OR ASSEMBLIES USING MICROWAVES

PRIORITY CLAIM

This application is based on and claims the priority under 35 U.S.C. §119 of German Patent Applications 197 21 461.4, filed on May 22, 1997, and 197 30 879.1, filed on Jul. 18, 1997. The entire disclosures of German Patent Applications 197 21 461.4 and 197 30 879.1 are incorporated herein by reference.

FIELD OF THE INVENTION

The invention relates to a method for drying lacquers and other coatings on metallic or non-metallic individual components or assemblies having any desired structural configuration, either in a batch process or in a continuous through-flow process within a heated drying chamber. The invention particularly relates to a method for drying lacquers or other coatings on aluminum components or fiber-reinforced composite components in the field of aircraft construction, wherein the coatings preferably comprise water-thinnable or solvent-containing one-, two- or more component lacquers with an epoxy or polyurethane base.

BACKGROUND INFORMATION

It is generally known to dry surface coatings, and especially two component lacquers applied onto metallic or non-metallic components, by means of warm air in a temperature range of e.g. 40 to 90° C., within a convection oven. It is also known to dry such lacquers by means of infrared radiation applied to the lacquer coated articles. Disadvantages common to these two known drying methods are a relatively high energy consumption and a relatively long drying time. Also, in the case of the infrared radiation drying, only components having a relatively simple geometric shape or configuration can be properly dried, because a more complicated geometry would form shadows in the infrared radiation and thus prevent proper uniform drying.

The publication "Deutsche Farben-Zeitschrift" ("German Color Journal") 23rd year, No. 12, (1969), page 585, mentions the possibility of drying lacquers by means of microwave radiation under the heading "Bestrahlung—moderne Trocknungsverfahren für Lacke". In this context, it was described that commercially available equipment can be used to generate microwaves in the range from $10^8$ to $10^{10}$ Hz, which are then directed at the lacquer film on an article so as to heat the film material, which thereby essentially has the effect of transforming the film into the solid state. The heating effect results from the arising dielectric losses, and is highly and immediately effective. Lacquer coatings containing water as a solvent are especially suitable. Such a microwave drying method is also applicable in principle for drying printing inks or dyes. However, it is doubtful whether standard lacquer systems without special dielectric characteristics would actually be dryable in practice by the method proposed in this publication. The described method will be unefficient because the microwaves just heating the thin coating layer which has a small heat capacity due to its low mass. The heat energy of the coating film will rapidly dissipated into the substrate (component) which is not heated up in this microwave process. In particular this will be a disadvantage using thick metall parts.

The English language Abstract of Japanese Patent Publication 4-260472(A), published in the Patent Abstracts of Japan, C-1021, Jan. 28, 1993, Vol. 17, No. 46, describes the use of a special paint coating film that contains a microwave-absorptive self-heat generating powder. In a drying method, such a paint coating film containing the special powder additive is subjected to microwave radiation, which heats the powder and thereby dries or hardens the paint coating film. In this context, the resins or other components of the paint coating film as well as the substrate material must be heat resistant to the necessary degree. Particular characteristics, which the paint coating film must apparently possess for carrying out the mentioned method, are not described in this English language abstract.

French Patent Publication 2,458,323 (Berteaud et al.) describes a method for coating a substrate, by means of which a thin layer of an overcoating is applied onto the substrate. The substrate may especially be made of glass or an analogous material. The overcoating is heat-processed by applying microwave energy thereto. The special feature in this context is that the microwave energy is within a particularly selected frequency range that is adapted for selectively exciting particular components of the overcoating layer. The microwave energy is controlled in such a manner that the frequency of the microwave radiation directed into the drying chamber is varied or adjusted to the extent necessary so that the temperature of the coating is maintained at a constant nominal value. This is achieved using a conventional and commercially available pyrometer. According to this conventional method, the microwaves act directly upon the coating layer. For this purpose, the lacquer or coating materials are partially modified or specially adapted for the microwave drying process, for example by the addition of carbon dust thereto. Only non-conducting substrate materials are used, whereby microwave frequencies higher than 2.45 GHz may also be used.

German Patent Laying Open Document 4,121,203 (Linden et al.) discloses a method and an apparatus for drying a water soluble dispersion lacquer or coating on paper or cardboard webs or sheets by means of microwaves. Preferably, a plurality of commercially available and accepted microwave oscillators are arranged so as to couple the microwave energy into a hollow wave guide. The webs or sheets of paper or cardboard material are dried in a continuous flow-through process, whereby a negligible residual moisture remains in the material, but the method uses a very economical minimum input of energy.

SUMMARY OF THE INVENTION

In view of the above it is an object of the invention to provide an energy saving drying method, which can achieve a rapid drying of components, and even components having a complicated geometrical configuration. The invention further aims to avoid or overcome the disadvantages of the prior art, and to achieve additional advantages, as are apparent from the present description.

The above objects have been achieved in a first method for drying lacquers and other surface coatings according to the invention, wherein the components having the surface coating thereon are placed in or passed through a drying chamber, microwaves generated by at least one microwave generator module are directed via hollow wave guides into the drying chamber, a gas such as preferably air is directed into the drying chamber so as to flow around the coated components, wherein the gas is supplemented or augmented with an additive agent having a dipole characteristic so as to form a gas mixture. Particularly, the gas mixture contains a relative proportion of the additive agent at a prescribed controllable value within the range from 20% to 90%. This relative proportional content of the additive agent is maintained within the drying chamber.

Generally according to the invention, the microwaves directed into the drying chamber serve to vibrationally excite and energize, and thus heat the dipole molecules of the additive agent in the gas mixture. As a result, the gas mixture environment becomes heated, and this heat is transferred to the surface coating and accelerates the drying or curing of the surface coating. More particularly, the gas mixture comprising air or some other gas with an additive agent mixed therein flows uniformly around the components arranged in the drying chamber, and the molecules of the gas mixture are then excited into vibration by the incident microwave energy. The heat energy resulting in the gas mixture in this manner is then transferred to the lacquer or coating surface that is to be dried or cured. This thermal energy has the effect of accelerating or enhancing the drying and curing, and particularly the chemical cross-linking of the coating layer. The term "drying" as used herein is intended to cover the concepts of physical drying by removal of moisture, hardening, curing, and polymerization of the coating film material, depending on the particular composition thereof. Two other effects are able to work together with the above mentioned drying effect in this invention:

a) Due to the polarizable dielectric additive agent used in the gas mixture the wavelength of the microwaves will change. This influences the drying and curing behaviour of the coating by accelerating the chemical cross-linking.

b) Depending on the particular chemical composition of the used coating and applied thickness of the coating film the microwaves are partially able to transmit the coating film down to the substrat (component). That will heat up the component surface. The intensity of the heating depends on the material of the components.

The inventive method advantageously achieves a rapid drying of coatings, at relatively low temperatures and with a uniform heating of the coating surfaces. This is especially advantageous for drying coatings on aluminum components or fiber reinforced composite components that are typically used in the field of aircraft construction. A uniform drying is achieved on components having any desired configurational geometry, even including overhangs, overlaps, recesses, protrusions and the like which would tend to create surface areas that are hidden from a line of sight. The components may be individual parts or assemblies including a plurality of pre-assembled parts. According to a further detail, the inventive method takes advantage of the circumstances, whereby at least a portion or component of the additive agent included in the gas mixture surrounding and flowing around the components serves as a catalyst, as a reaction partner, as a polymerization accelerator, or as a cross-linking agent for achieving a more effective chemical reaction, and especially polymerization and curing, and particularly cross-linking, of the coating layer.

In this context, for example nine microwave generator modules, each having four magnetrons with a high frequency power output of for example 1.2 kW each can be used for generating the microwave energy. Accordingly, in this example, it can be seen that the total applied power is 43.2 kW, of which approximately 36 kw is actually usable.

The above objects have further been achieved in a second embodiment of a method according to the invention, wherein the lacquer or coating layer itself is supplemented or enriched with a polarizable dielectric substance as an additive agent. Microwaves generated by at least one microwave generating module and directed into the drying chamber via hollow wave guides impinge upon the coating and excite the polarizable dielectric substance within the coating, which thus serves to directly heat the lacquer or coating. Additionally or alternatively, the polarizable dielectric substance or some other component of the additive agent is emitted out of the coating, e.g. by evaporation, into the air or other gas surrounding the components so as to form a gas mixture of the gas and the dielectric substance. Then, the dielectric substance is further energized by the microwaves and serves to heat the gas mixture and thus indirectly heat the coating.

BRIEF DESCRIPTION OF THE DRAWINGS

In order that the invention may be clearly understood, it will now be described in connection with example embodiments, with reference to a single drawing FIGURE which is a schematic block diagram in a sectional view of a representative example of a system for carrying out the inventive method.

DETAILED DESCRIPTION OF PREFERRED EXAMPLE EMBODIMENTS AND OF THE BEST MODE OF THE INVENTION

The single drawing Figure schematically shows a system or apparatus for carrying out the inventive method. It should be understood that the drawing Figure does not depict an actual realistic construction of a suitable apparatus, but is merely a schematic illustration for purposes of discussion. As shown in the drawing Figure, the apparatus or system 1 comprises a dryer housing 2 enclosing a drying chamber 2A therein. In the drawing the complete dryer chamber 2A is set together out of two microwave generator modules 3 and two microwave generating magnetrons 3A are connected to each microwave generator module 3. Via respective hollow wave guides 4 the microwaves are directed in a desired pattern into the drying chamber 2A through microwave introduction ports 4A having a predefined configuration and arrangement. The magnetrons 3A can be protected against moisture, water vapor or steam used for the inventive method by a "TEFLON®" screen 15 which is nearly 100% permeable for the microwaves. For a realistic construction a plurality of microwave generator modules 3 can be assembled for a complete system.

A blower 5 or other source of flowing air or other gas is connected to the dryer housing 2 by a suitable air duct or conduit, so as to provide a flow of gas into the drying chamber 2A through a gas inlet 6. After the gas flows uniformly through the drying chamber 2A, it is exhausted or recaptured and recirculated from a gas outlet 7. An auxiliary blower may be arranged within the drying chamber 2A to provide a homogeneously and uniformly distributed airflow within and throughout the drying chamber 2A.

In order to mix an additive agent into the gas flow according to the first embodiment of the invention, several different alternatives are possible. Preferably, the additive agent is simply water vapor or steam, and the flowing gas is simply air. According to a first possibility, a nebulizer or atomizer 8A including a fine misting, fogging or atomizing nozzle 8' is connected to the blower 5 or to the air duct between the blower 5 and the dryer housing 2, or directly to the dryer housing 2 or in the drying chamber 2A. The nozzle 8' provides an atomized mist or fog of water or other additive agent into the gas flow, so as to produce a gas mixture of a vapor of the additive agent within the gas. Any other known type of air conditioning equipment, such as a humidifier, can be used to introduce a vapor of the additive agent into the drying chamber 2A.

Alternatively, such a nebulizer or atomizer 8B having a fine misting or fogging nozzle 8' can be arranged at the hollow waveguides 4 of one or more magnetrons 3A of the microwave generator modules 3. In this way, the magnetrons 3A are preferably cooled by an adapted blower which is blowing the heated air via the hollow wave guides 4 through the microwave introduction ports 4A into the drying chamber 2A. In this connection, a vapor of the additive agent is introduced into the drying chamber 2A together with the heated air flow and microwaves through the microwave introduction ports 4A. For this design no Teflon screen 15 is used in the hollow wave guides 4. According to another alternative, a vapor blower 8C contains a solution of the additive agent having a known or prescribed vapor pressure, and includes a blower for blowing the resulting additive agent vapor into the drying chamber 2A. Such a vapor blower 8C is preferably arranged in the same way at the hollow wave guides 4 of one or more magnetrons 3A as a nebulizer or atomizer 8B mentioned above.

In any event, the additive agent vapor is mixed into the gas and introduced into the drying chamber 2A at a rate sufficient to achieve the desired relative proportional content of the additive agent, in the range from 20% to 90%. In the case of water vapor as the additive agent, the relative proportional content of the additive agent would be a relative moisture content or relative humidity of the gas mixture. A controller 11 controls the blower 5, the atomizers 8A, 8B and/or 8C, the high voltage supply 13 of each magnetron 3A and the microwave generator modules 3, to achieve and maintain the desired processing conditions within the drying chamber 2A.

Components 9, such as structural components to be used in aircraft construction, have a surface coating 9' such as a lacquer or paint film previously applied thereto. The components 9 are conveyed into the drying chamber 2A on a conveyor arrangement 10, which may be a conveyor belt or an overhead chain conveyor from which the components 9 hang. The conveyor arrangement 10 continuously moves the components through the inlet microwave absorber 12, the drying chamber 2A and the outlet microwave absorber 12 to carry out the inventive method in a continuous flow-through process. The absorber 12 is necessary to avoid microwave leakage into the surrounding area of the machine 1. For the absorber 12 may used, for example, a water circulation line with a heat exchanger 14 to cool the microwave heated water down. Alternatively, the apparatus may be operated in a batch process in which a plurality of the components 9 are loaded into the drying chamber 2A, and then remain stationary within the drying chamber 2A while the drying process is carried out to completion. The components 9 may have any desired configuration, regardless how geometrically complex. Each component 9 may be an individual part or a pre-assembled assembly of many different parts. The components 9 may be placed directly on the conveyor arrangement 10, but preferably can be placed in or on respective bins, so called totes, containers or pallets 9A, depending on the size and configuration of the components 9.

As already explained above, the microwave energy introduced into the drying chamber 2A by the magnetrons 3A serves to vibrationally excite and thus heat the additive agent molecules in the gas mixture that uniformly surrounds the components 9 having the lacquer or other coating film 9' thereon. As a result, the gas mixture environment within the drying chamber 2A becomes heated, completely independent and regardless of the material of the components 9 or the composition of the coating film 9'. The heat from the gas mixture is transferred to the coating films 9' and accordingly accelerates or enhances the curing and drying of the coating films 9'. As a result, the present method is applicable to metal components 9, such as aluminum or aluminum alloy aircraft components, and is also applicable to non-metal components 9 such as fiber reinforced composite components used for example in aircraft construction. Also, the present method is applicable to essentially any composition of coating film 9' such as one-, two-, or more component lacquers based on epoxies or polyurethanes, or lacquers or coatings having other chemical compositions, such as alkyde resin lacquers.

In order to achieve a uniform drying of the coating film 9' on all coated surfaces of a component 9 having a complicated geometry, it is preferable to produce an inhomogeneous microwave field and/or an inhomogeneous distribution of the gas mixture within the drying chamber 2A. This can be achieved according to the invention by appropriately controlling the high frequency power of the magnetrons 3A of the microwave generator modules 3, the particular arrangement of the microwave introduction ports 4A, the ratio of the additive agent relative to the gas in the gas mixture, the rate of introduction of the gas mixture, and/or the specific arrangement of one or more gas inlets 6.

According to the second embodiment of the inventive method, an additive agent is not mixed directly into the gas flow introduced into the drying chamber 2A. Instead, an additive agent is mixed into or applied onto the lacquer or other coating film 9' on the components 9. Thus, a system or apparatus for carrying out the second embodiment of the inventive method is similar to that shown in the single drawing Figure, but may omit the additive agent vaporizers or the like 8A, 8B and 8C.

Particular details of carrying out the second embodiment of the inventive method are as follows. The additive agent comprising a polarizable dielectric substance may be mixed into the lacquer or other coating material before it is applied as a coating film 9' onto the components 9. Alternatively, the additive agent may be added to the coating composition during its application onto the components 9, for example by simultaneous spraying from a twin spray head. As further alternatives, the additive agent may be applied onto the coating film 9' after the film has been applied onto the components 9, or the additive agent may be applied onto the surface of the components 9 before the coating film 9' is applied thereover.

Especially in this embodiment, the lacquer or coating composition may be based on an alkyde resin or an acrylic resin or other chemical basis, in addition to the above mentioned epoxy or polyurethane based coatings. The additive agent may comprise water contained in a water-based or water-thinnable lacquer or coating composition, whereby the water forms water vapor that is emitted out of the coating film 9' as it is heated by the incident microwave radiation during the drying process. As a result, the water vapor forms a gas mixture together with the gas in the drying chamber 2A, whereby the gas mixture may be further heated by the microwaves, and in turn further accelerate the drying process.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A method of drying a coating on a component, comprising the following steps:

a) disposing said component with said coating on a surface thereof in a drying chamber;

b) providing a gas and mixing molecules of an additive agent into said gas to form a gas mixture, wherein said molecules of said additive agent are energizable by microwave energy;

c) flowing said gas mixture over said coating on said surface of said component within said drying chamber; and d) generating and directing microwaves into said drying chamber containing said gas mixture.

2. The method according to claim 1, further comprising a step f) of energetically exciting and thereby heating said molecules of said additive agent in said gas mixture, and then transferring heat from said gas mixture to said coating on said component so as to bring about said drying of said coating.

3. The method according to claim 2, wherein said drying comprises polymerization of said coating.

4. The method according to claim 1, wherein said molecules of said additive agent have a dipolar character, whereby said molecules are vibrationally excitable and thus energizable by said microwaves.

5. The method according to claim 1, wherein said step of mixing said molecules of said additive agent into said gas is carried out in such a manner that said gas mixture contains a relative content of said additive agent in a range from 20% to 90%.

6. The method according to claim 5, further comprising controlling said steps b) and c) so as to achieve and maintain a selected value of said relative content of said additive agent within said drying chamber.

7. The method according to claim 1, wherein said component is a metal component.

8. The method according to claim 7, wherein said metal component comprises aluminum.

9. The method according to claim 1, wherein said component is a non-metal component.

10. The method according to claim 9, wherein said non-metal component is a fiber-reinforced composite component.

11. The method according to claim 1, wherein said component has a complex structural configuration including at least one of an overhang, a recess, an undercut, and a protruding portion, and including at least one surface area that is not exposed to a line of sight.

12. The method according to claim 1, wherein said coating comprises at least one of a one-component coating and a two-, or more component coating comprising at least one of an epoxy base and a polyurethane base.

13. The method according to claim 1, wherein said coating is a water-thinnable and water-containing coating.

14. The method according to claim 1, wherein said coating is a non-water solvent-thinnable and solvent-containing coating.

15. The method according to claim 1, wherein said method is carried out in a batch process, and wherein said step a) comprises loading said component into said drying chamber and then holding said component stationary while said steps b) to d) are carried out.

16. The method according to claim 1, wherein said method is carried out in a continuous flow-through process, wherein said step a) comprises moving said component into and through said drying chamber by means of a conveyor apparatus, while said steps b) to d) are carried out.

17. The method according to claim 16, wherein said conveyor apparatus used in said step a) is a chain conveyor or equivalent equipment, and further comprising having said component hang from said chain conveyor or equivalent equipment as said component is moved into and through said drying chamber.

18. The method according to claim 1, wherein said gas is air.

19. The method according to claim 18, wherein said additive agent is water vapor.

20. The method according to claim 1, wherein said step d) comprises generating said microwaves using at least one microwave generator module and directing said microwaves into said drying chamber from said at least one magnetron via at least one hollow wave guide and at least one microwave introduction port respectively provided on said at least one hollow wave guide.

21. The method according to claim 20, wherein said step of mixing molecules of said additive agent into said gas comprises spraying said additive agent through at least one nebulizing nozzle arranged at the hollow wave guide of at least one magnetron, and then introducing said additive agent into said drying chamber.

22. The method according to claim 20, wherein said step of mixing molecules of said additive agent into said gas comprises arranging a solution of said additive agent that provides a predetermined vapor pressure of a vapor of said additive agent at the hollow wave guide of at least one magnetron, and blowing said vapor of said additive agent into said drying chamber using a blower.

23. The method according to claim 1, wherein said step of mixing molecules of said additive agent into said gas comprises introducing said additive agent into said drying chamber using a humidifying apparatus.

24. The method according to claim 1, wherein said step of mixing molecules of said additive agent into said gas comprises providing said additive agent in or on said coating, and evaporating said additive agent from said coating into said gas within said drying chamber to form said gas mixture in said drying chamber.

25. The method according to claim 1, wherein said step d) is carried out so as to form an inhomogeneous microwave field in said drying chamber.

26. The method according to claim 1, wherein said coating comprises an alkyde resin.

27. The method according to claim 1, wherein said coating comprises an acrylic resin.

28. The method according to claim 1, wherein said additive agent comprises a substance that is adapted to be at least one of a catalyst, a reaction partner, a polymerization accelerator and a cross-linking agent for said coating for influencing said drying of said coating.

29. A method of drying a coating on a component, comprising the following steps:

a) applying a coating of a coating material onto a surface of said component, and supplementing said coating material with an additive agent comprising a polarizable dielectric;

b) disposing said component with said coating thereon in a drying chamber;

c) providing a gas in said drying chamber;

d) generating and directing microwaves into said drying chamber, so as to impinge on said coating;

e) energetically exciting and heating said polarizable dielectric by said microwaves, and thereby achieving at least one of a first result of direct heating said coating supplemented with said additive agent comprising said polarizable dielectric, and a second result of evaporating at least some of said additive agent from said coating into said gas in said drying chamber so as to form a gas mixture comprising said gas and said at least some of said additive agent and so as to heat said gas mixture by energetically exciting said at least some of said additive agent in said gas mixture by said microwaves.

30. The method according to claim 29, wherein said step e) comprises evaporating at least some of said additive agent from said coating into said gas in said drying chamber, so as to form a gas mixture comprising said gas and said at least some of said additive agent, and so as to heat said gas mixture by energetically exciting said at least some of said additive agent in said gas mixture by said microwaves.

31. The method according to claim 29, wherein said additive agent comprises water, and wherein said evaporating in said step e) comprises forming water vapor of said water and evaporating said water vapor into said gas to form said gas mixture.

32. The method according to claim 29, wherein said step of supplementing said coating material with said additive agent comprises mixing said additive agent into said coating material before applying said coating material onto said component.

33. The method according to claim 29, wherein said step of supplementing said coating material with said additive agent comprises adding said additive agent to said coating material as it is applied onto said component.

34. The method according to claim 29, wherein said coating material comprises an alkyde resin.

35. The method according to claim 29, wherein said coating material comprises an acrylic resin.

* * * * *

UNITED STATES PATENT AND TRADEMARK OFFICE

CERTIFICATE OF CORRECTION

PATENT NO. : 5,974,687

DATED : Nov. 2, 1999

INVENTOR(S) : Thomas Gante et al.

It is certified that error appears in the above-identified patent and that said Letters Patent is hereby corrected as shown below:

On the title page item [73],

Under ASSIGNEE, after "Aerospace" insert -- Airbus GmbH --;

Signed and Sealed this

Fifteenth Day of August, 2000

*Attest:*

Q. TODD DICKINSON

*Attesting Officer*

*Director of Patents and Trademarks*